US005131244A

United States Patent [19]

Plath et al.

[11] Patent Number: 5,131,244

[45] Date of Patent: Jul. 21, 1992

[54] KNITTING MACHINE WITH THREAD EXCHANGE DEVICE

[75] Inventors: Ernst-Dieter Plath, Albstadt-Tailfingen; Eduard Steidle, Tuttlingen-Möhringen, both of Fed. Rep. of Germany

[73] Assignee: Beteiligungs- Sipra Patententwicklungs- und Gesellschaft mbH, Albastadt-Tailfingen, Fed. Rep. of Germany

[21] Appl. No.: 583,959

[22] Filed: Sep. 14, 1990

Related U.S. Application Data

[63] Continuation of Ser. No. 239,704, Aug. 31, 1988.

[30] Foreign Application Priority Data

Sep. 18, 1987 [DE] Fed. Rep. of Germany ..... 3731379

[51] Int. Cl.[5] ..... D04B 15/62

[52] U.S. Cl. ..... 66/144; 66/125 R; 66/132 T

[58] Field of Search ..... 66/125 R, 132 T, 144

[56] References Cited

U.S. PATENT DOCUMENTS 3,737,112 6/1973 Tellerman et al. ..... 66/125 X
4,531,385 7/1985 Jacobsson ..... 66/132 T
4,691,535 9/1987 Cottenceau et al. ..... 66/144
4,752,044 6/1988 Memmineer et al. ..... 66/125 R X

FOREIGN PATENT DOCUMENTS 3015191 11/1981 Fed. Rep. of Germany .
3620296 1/1987 Fed. Rep. of Germany .

*Primary Examiner*—Werner H. Schroeder
*Assistant Examiner*—John J. Calvert
*Attorney, Agent, or Firm*—Michael J. Striker

[57] ABSTRACT

An annular knitting machine comprises a thread exchange device, at least one knot unit, means forming a thread processing point, a thread storage device located between the knot unit and the thread processing point, and a control device provided with a microprocessor and a knot data storage for the thread exchange device, the thread exchange device having a sensor which supplies pulses dependent upon a movement of a machine part, the control device also having a microprocessor and a knot data storage and formed so that a length of a thread which is guided through the thread storage device between each knot unit and the thread processing point associated with the latter is maintained at a constant value fixed in the storage of the control device, the sensor supplying movement dependent pulses and being formed as a displacement sensor which is independent of a needle pitch of a needle plate and provides a fixed pulse number per a displacement length unit.

2 Claims, 3 Drawing Sheets

KNITTING MACHINE WITH THREAD EXCHANGE DEVICE

Related Applications

This application is a continuation of application Ser. No. 239,704 filed Aug. 31, 1988 and entitled "Knitting Machine with Thread Exchange Device."

BACKGROUND OF THE INVENTION

The present invention relates to a knitting machine with a thread exchange device, with at least one knot unit and a thread processing point of the knitting machine, and with a control device which has a microprocessor and a knot data storage for the thread exchange device, wherein the control device has a sensor which delivers pulses depending on the movement of the machine parts.

Knot units as thread exchange devices (U.S. Pat. Nos. 4,531,385 and 4,691,535) are used in knitting machines on an increased scale, in which during a thread exchange the new thread is tied with the old thread to make a knot. In this manner, exactly localized thread exchange points are produced in a knitted texture, which is especially advantageous during a color exchange. However, as for the control, there is a problem to control the knot unit and the thread supply so that the knots appear in the knitted article exactly on the desired thread exchange points. The known control devices for solving the above-mentioned problem have the disadvantage in that a great number of sensors is required and correspondingly a great number of measuring data in the control device must be considered, which makes the construction of the control device complicated.

SUMMARY OF THE INVENTION

Accordingly, it is an object of the present invention to provide a knitting machine of the above mentioned general type which avoids the disadvantages of the prior art.

More particularly, it is an object of the present invention to provide a knitting machine of the above mentioned general type, in which the control device for the thread exchange device is simplified without reducing its accuracy and operational safety.

In keeping with these objects and with others which will become apparent hereinafter, one feature of the present invention resides, briefly stated, in that the length of a thread which is guided through a thread guiding device between each knot unit and its associated thread processing point is maintained as a constant value which is fixed in a storage of a control device, and a sensor delivers movement-dependent pulses is a displacement sensor which is independent of a needle pitch of a needle plate and has fixed pulse number per displacement length unit.

Since the length of the thread between the knot unit and the thread processing point is maintained constant and also a thread length which is required for a desired loop length is stored, in the control device in accordance with the present invention special sensors for detecting the yarn movement to a thread storage and the yarn movement from a thread storage further to thread processing points and correspondingly supply the evaluated data to a microprocessor of the control device, can be dispensed with. Thereby a significant simplification of the control device and an acceleration of the control process is obtained.

A further simplification of the control device is obtained in that a displacement sensor which is independent of the needle pitch of the needle plate is used, which also over the whole displacement length delivers a predetermined pulse number, independent of whether a knitting machine has a fine or a coarse needle pitch. The displacement sensor brings an additional advantage in that each its pulse identifies a predetermined point of the needle plate.

A simplification of the signal evaluation and thereby also the construction of the control device can be obtained with a displacement sensor which additionally after each displacement length which corresponds to the whole length of a needle plate or in annular knitting machines to a needle cylinder revolution, supplies a zero pulse so that the pulses for each displacement path are counted anew from zero. By these features it is obtained that an error which eventually occurs on a displacement path and provides a displacement of a knot length in a knitted article is not repeated in subsequent displacement paths. The error cannot be added.

With the knitting machine designed in accordance with the present invention a knot unit can be controlled so reliably that controls of the control device through a location of the knot length in the knitted article which are very difficult to implement, can be saved.

The above mentioned thread storage device can be formed first of all as storage drums over which the threads are placed in several windings. These storage drums can be arranged in so-called furnishers and formed either as continuously driven storage drums or stationary storage drums. In the first case the storage drums do not form real thread storages, but instead activate a movement which depends on the respective operational speed of the knitting machine and the thread consumption and provides a positive thread supply for the thread working point in which the thread is supplied with a uniform tension and thread quantity. In the other case, in the event of the stationary storage drum, the drum forms a real thread storage on which the thread is wound by means of a first thread finger and from which it is unwound by a second thread finger.

In each case in the knitting machine formed in correspondence with the present invention, for insuring a constantly remaining thread length between the knot unit and the thread processing point, always the same windings number is maintained. In a thread storage device with a stationary storage drum this can be guaranteed in that the winding fingers are positively subject to a synchronous movement. For example, the second winding finger can be driven in rotation by a thread pull applied by the processing needle, and a pulse sensor whose pulses activate a stepper motor which moves a first winding finger. The stepper motor forces the first winding finger to a synchronous post-supply of a thread to the storage drum.

A further simplification of the control device occurs when the parts of the control device are arranged on individual knot units, for example an adjustable thread length storage and naturally sensors which can monitor the position of the knot unit points. The thread length between the knot unit and the thread processing point can be different in several knot units. They and also the thread length required for a desired loop length, are measured on each knot unit before the beginning of the knitting process, and given on the individual knot units or on the central control device individually in the thread length storage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
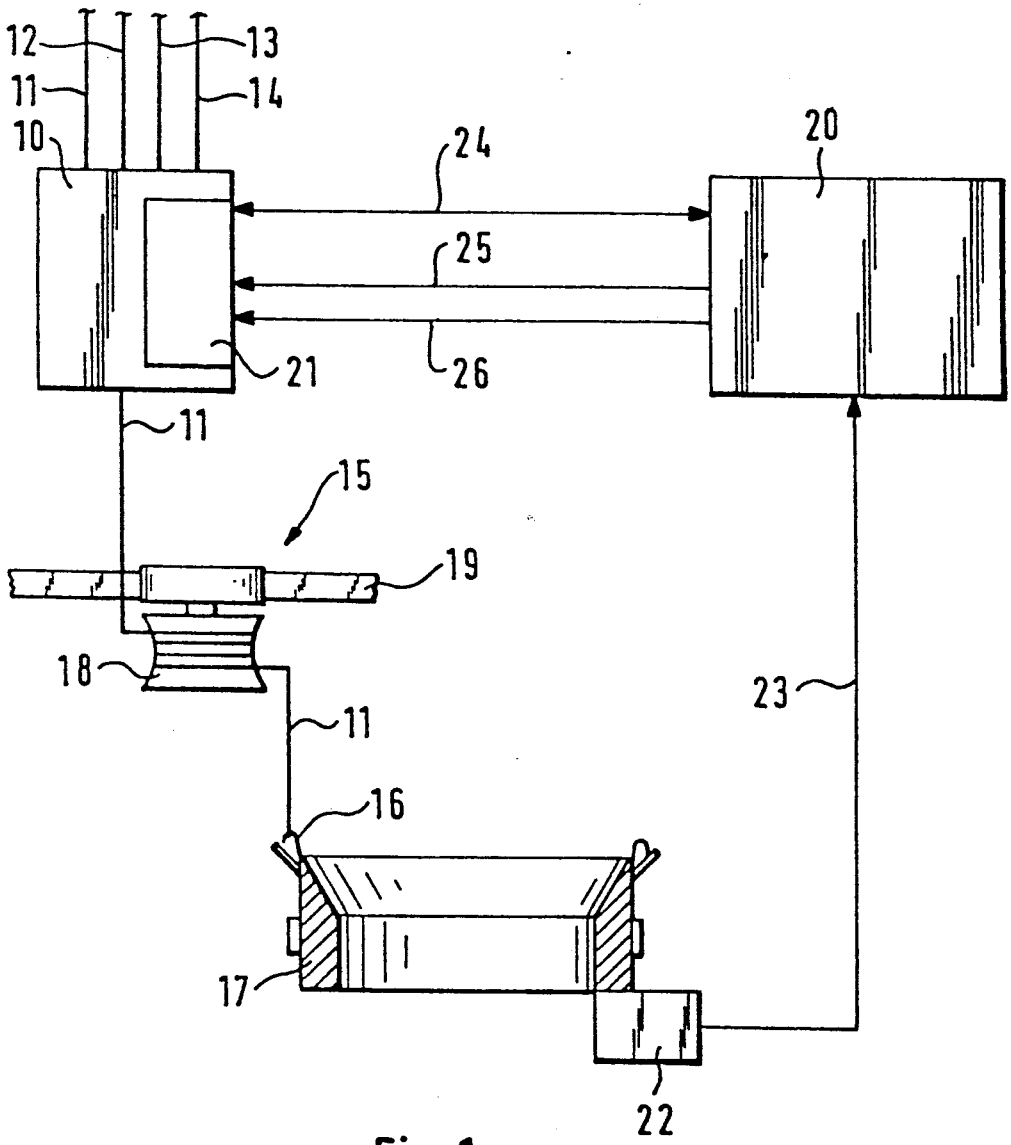
FIG. 1 is a schematic block diagram of inventive parts of a thread exchange device for an annular knitting machine, for producing bindings with a uniform thread consumption.

In FIG. 1 a knot unit 10 of a thread exchange device is shown schematically as a block. The construction function and control of the knot unit is known in the art and therefore not shown in detail.

Four threads 11, 12, 13 and 14 are supplied to the knot unit, so that it is possible to select between these threads a new thread with which the already used thread, for example thread 11 is tied. The respective selected threads 11-14 are guided from the knot unit 10 through a so-called positive furnisher 15 to a thread processing location 16 of an annular knitting machine which is shown schematically by its needle cylinder 17.

In the positive furnisher the threads are placed in several windings over a storage drum 18. The storage drum is driven by means of a drive band 19 in dependence upon a thread consumption and upon a rotary speed of the needle cylinder 17 of the annular knitting machine. By the positive furnisher 15 the respective threads 11-14 are supplied tangentially to the thread processing location 16, positively in the required quantity and thereby with a uniform tensioning. By the positive drive of the storage drum 18 it is insured that always the same quantity of thread are wound on the storage drum 18, as tangentially withdrawn at the lower end of the storage drum 18. Correspondingly, with each operational speed of the needle cylinder 17 the length of the thread which extends from the knot unit 10 through the positive furnisher 15 to a thread processing point 16 remains always the same. Each system has a storage drum, and each storage drum supports the same number of the thread windings.

During knitting, a control device 20 controls the knot unit 10 by means of at least first and second pulses. Normally the first or zero pulses determine when a thread change shall take place and select one of the threads which is to be knotted to the continuous thread. The second or timing pulses define the exact points in time when this change has to take place. Details of such a control are fully shown and described in U.S. Pat. No. 4,531,385 and, therefore, only those parts of our control device are now described which are necessary to fully understand this invention.

Annular knitting machines are mainly designed as multi-system machines, and one knot unit 10 is associated with each system. All knot units 10 of an annular knitting machine are coupled with a joint control device 20, and each knot unit 10 has its own control part 21 which is a part of the total control device of the annular knitting machine. The control device 20 includes a displacement sensor which in the shown annular knitting machine is formed as an angular turning sensor 22 and is connected drivingly with the rotatable needle cylinder 17 of the annular knitting machine. The angular turning sensor supplies during a full revolution of the needle cylinder 17, a fixed number of pulses and after full needle cylinder revolution a zero pulse through a control conduit 23 to the central control device 20 and to the control parts 21. The control device 20 has for each connected knot unit 10 and its control part 21 a special section point. Through a first control connection 24, the knot unit 10 obtains from the central control device 20 command pulses when knotting must be performed. The control device 20 includes a not shown microprocessor and a pattern storage. Moreover, acknowledgement signals of the knot unit 10 are supplied to the control device 20 through this connection 24. Through a second connection 25, the control part 21 of the knot unit 10 obtains the timing pulse of the angular turning sensor, and through a third control connection 26 zero pulse is supplied from the angular turning sensor 22. In the control part 21 of each knot unit 10 an adjustable thread length storage can be mounted in a not shown manner, and at least one counter actuated by the timing pulse of the angular turning sensor and its zero pulse can be arranged. The control part 21 can also have its own microprocessor which determines the time of the release signal for the knot formation in a speed dependent fashion, from the signals supplied from the central control device 20 with consideration of individual switch delaying time in the individual knot units 10. The machine speed is determined from the timing pulses/time unit of the displacement sensor.

Also, a central microprocessor can be provided in the control device 20. The data adjusted on the control part 21 of each knot unit are supplied to the control device 20 and then the release signals for knot formation are counted for each knot unit 10 and supplied in respective time.

The pulse number of the angular turning sensor during a full revolution of the needle cylinder 17 is fixed, independently of the diameter of the needle cylinder and its needle pitch. Thereby the control device can be adjusted to each annular knitting machine without complicated adaptation problems. The counting step in the control part 21 of each knot unit 10 is adjusted during each revolution of the needle cylinder 17 back to zero.

From the timing pulses of the angular turning sensor 22, at each time point the instantaneous speed of the knitting machine can be calculated and taken into consideration during the determination of the time point of the knot formation. In the central control unit 20 the thread consumption per needle during the loops formation is maintained in the pattern storage, and correspondingly the drive speed of the positive furnisher 18 which is held proportional to the drive of the needle cylinder 17 is adjusted.

With the above described control device, stripped goods and intarsia goods can be produced, in which the knots arranged in different loop rows are placed exactly vertically one after the other or at predetermined locations.

Figure 2:
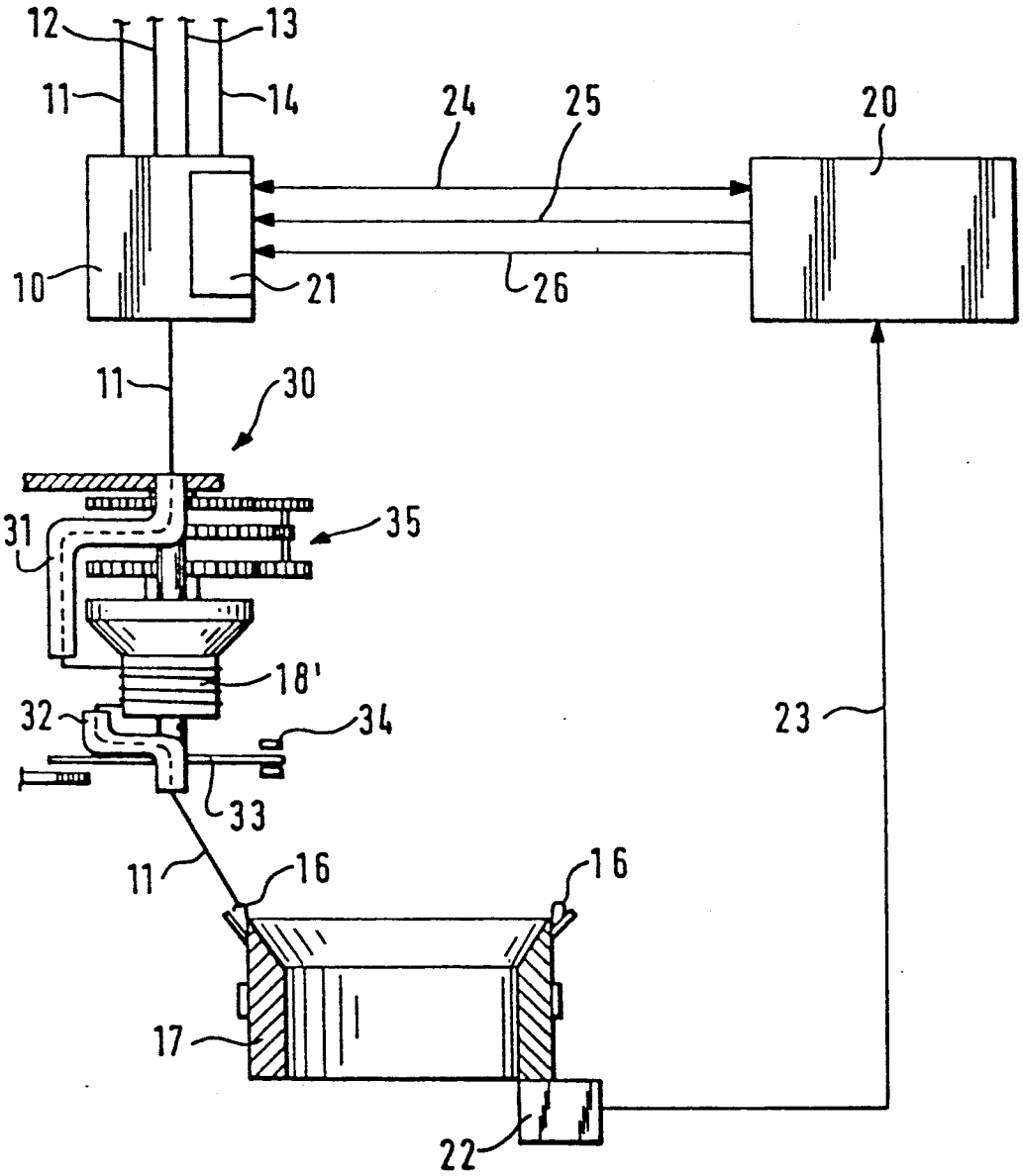
FIG. 2 is a view of a second embodiment of the thread exchange device of an annular knitting machine, corresponding to FIG. 1 for producing binding with changing thread consumption, for example for Jacquard pattern or intarsia pattern.

FIG. 2 shows the construction of the thread exchange device for the annular knitting machines, on which Jacquard pattern must be produced, wherein contrary to the embodiment of FIG. 1, with all needle processing points 16 characterized with an identical thread consumption, the thread consumption on the individual thread processing points 16 varies. Also in FIG. 2 a thread processing point 16 is schematically identified by a needle, and all identical parts are identified with the same reference numerals as in FIG. 1.

The device of FIG. 2 differs from the device of FIG. 1 substantially in that instead of positive furnisher 15, a real storage furnisher 30 is provided with a stationary storage drum 18'. Threads 11-14 which come from the knot unit 10 are wound by a first driveable winding finger 31 onto the immovable thread drum 18'. By means of a second rotatable winding finger 32, the thread is pulled from the stationary storage drum 18' and supplied to a thread processing point 16. The thread pulling can be performed by positive drive of the second winding finger 32. In this case it is presumed that the rotary movement of the second winding finger 32 is actuated by the pulling which is supplied to the thread 11 by the needle on the thread processing point 16. Each rotary movement of the second winding finger 32 is detected on a co-moving disc 33 by means of sensors 34. The pulses supplied by the sensors 34 activate a positive drive of the first winding finger 31 through a not shown drive motor so that so much of a thread length is wound from the first winding finger 31 onto the storage drum 18', as withdrawn by the second winding finger 32. Thereby the control device satisfies a very important requirement in that the length of the thread between the knot unit 10 and the associated thread processing point 16 always remains the same. A schemetically shown transmission 35 ensures that with the rotatable winding fingers the storage drum remains immovable.

Figure 3:
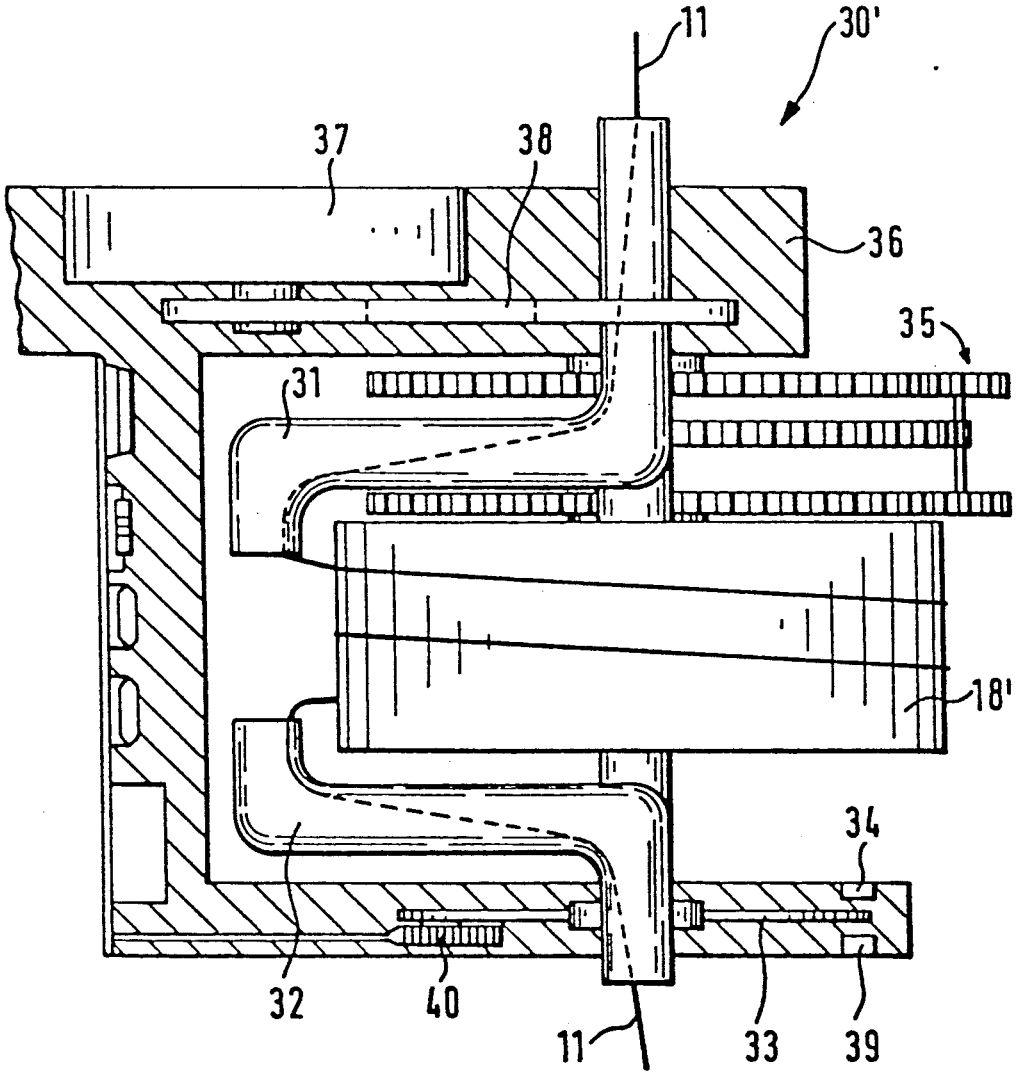
FIG. 3 is an enlarged view of a storage furnisher, partially in a vertical, longitudinal section.

FIG. 3 shows a possible embodiment of a storage furnisher 30'. The stationary storage drum 18' is arranged in a common support 36, and both winding wingers 31 and 32 are rotatably supported so as to be coaxial to the storage drum 18'. The first winding finger 31 is driven by a stepper motor 37 which is arranged in the support 36, through and endless toothed rim 38 which connects the winding finger 31 with the stepper motor 37 in a driving manner. The second winding finger 32 is fixedly connected with an aluminum disc 33 which can be provided with a plurality of teeth on its one edge. During rotation of the winding finger, pulse are produced in an optical sensor 34 which is supplied from a light source 39. These pulses are evaluated for driving the stepper motor 37 and thereby the first winding finger 31. Simultaneously, the aluminum disc 33 serves as an eddy-current braking disc in cooperation with a winding 40.

It will be understood that each of the elements described above, or two or more together, may also find a useful application in other types of constructions differing from the types described above.

While the invention has been illustrated and described as embodied in a cicular knitting machine with thread exchanging device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread exchange device for a circular knitting machine with a rotary needle cylinder having a needle pitch and at least one thread processing station for producing a fabric with a plurality of threads according to a pattern, comprising a thread knot unit for knotting sections of said threads to form a continuous thread; a control device coupled to said knot unit for selecting threads lengths from said plurality of threads and for controlling said knot unit for knotting the threads to said continuous thread by means of zero pulses and timing pulses in such a way that knots always occur at predetermined same vertical regions of said fabric, said control device having means for producing independently of said needle pitch said zero pulses at the end of every revolution of said needle cylinder and a fixed plurality of said timing pulses during every revolution of said needle cylinder; and a thread storage device located between said knot unit and said thread processing station for feeding said continuous thread to said thread processing station, a length of said continuous thread stored in said thread storage device being kept at a same and constant value whereby an overall length of said continuous thread between said knot unit and said thread processing station is being kept constant to thereby insure positioning of knots at predetermined same region of a fabric during knitting, said constant value of said length of said continuous thread stored in said thread storage device being storable in said control device.

2. A thread exchange device according to claim 1, wherein said thread storage device is a positive thread supply device which has a storage drum driven in dependence upon thread consumption at said processing station, and wherein said storage drum carries a predetermined number of thread windings for keeping constant said value.

* * * * *